US006808085B2

(12) United States Patent
Greiner-Perth et al.

(10) Patent No.: US 6,808,085 B2
(45) Date of Patent: Oct. 26, 2004

(54) MEDIA DISPENSER

(75) Inventors: Juergen Greiner-Perth, Gottmadingen (DE); Hans Merk, Gaienhofen-Horn (DE); Thomas Eberhard, Randolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/947,655

(22) Filed: Sep. 6, 2001

(65) Prior Publication Data

US 2002/0066753 A1 Jun. 6, 2002

Related U.S. Application Data

(63) Continuation-in-part of application No. 09/615,391, filed on Jul. 13, 2000, now abandoned.

(30) Foreign Application Priority Data

Jul. 16, 1999 (DE) ..... 199 33 330

(51) Int. Cl.[7] ..... B67D 5/52; B65D 25/08

(52) U.S. Cl. ..... 222/136; 222/189.09; 206/221

(58) Field of Search ..... 222/129, 136, 222/135, 189.09, 182, 153.13, 153.1, 321.1, 321.7, 321.9; 206/222, 219, 221; 215/DIG. 8

(56) References Cited

U.S. PATENT DOCUMENTS

| | | | | |
|---|---|---|---|---|
| 3,966,089 A | | 6/1976 | Klingaman | |
| 4,705,191 A | * | 11/1987 | Itzel et al. | 222/80 |
| 4,832,230 A | * | 5/1989 | Janowitz | 222/80 |
| 5,647,481 A | | 7/1997 | Hundertmark et al. | |
| 5,715,974 A | * | 2/1998 | Foster et al. | 222/383.1 |
| 5,811,060 A | * | 9/1998 | Laguna Valderrama | 422/102 |
| 5,893,452 A | * | 4/1999 | de Nervo | 206/219 |
| 5,950,819 A | * | 9/1999 | Sellars | 206/221 |
| 6,425,499 B1 | | 7/2002 | Guiffray | |

* cited by examiner

*Primary Examiner*—Kevin Shaver
*Assistant Examiner*—Stephanie Willatt
(74) *Attorney, Agent, or Firm*—Quarles & Brady LLP

(57) ABSTRACT

A first reservoir body (13) includes two necks (19, 20). One neck (19) carries a thrust piston pump (11) including a medium outlet (37). The other neck (20) carries a closed second reservoir body (14) including a second medium. When the closure (9) is opened, the second medium is transferred into the first reservoir body (13) where it is mixed with or dissolved in the first medium. Thereafter, the mixed media can be discharged by the dosing pump (11) from the first reservoir body (13) in discrete doses in sequence. Thus, the media are stored separately and are not merged until being discharged.

17 Claims, 8 Drawing Sheets

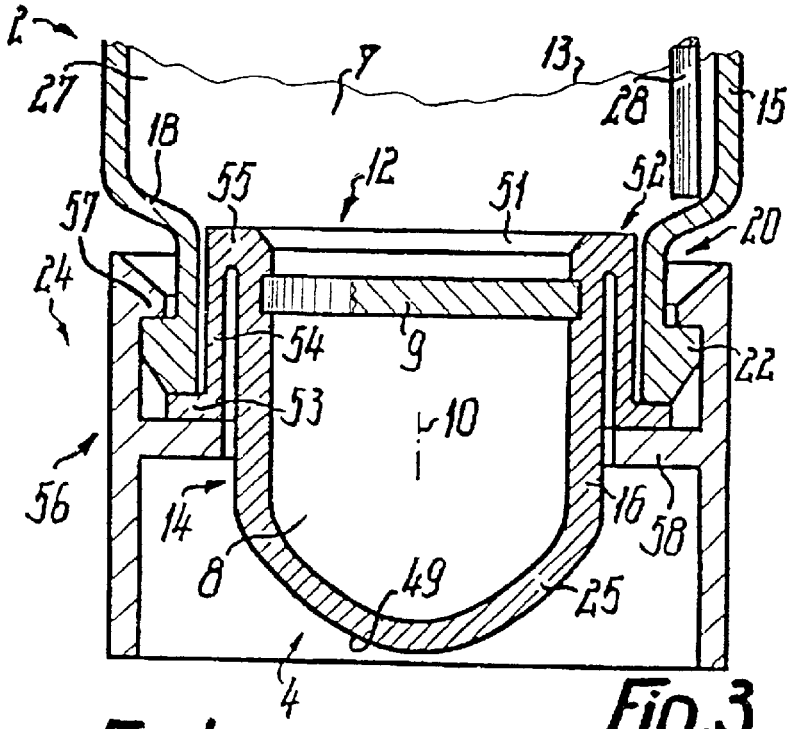
Fig.3
Fig.4
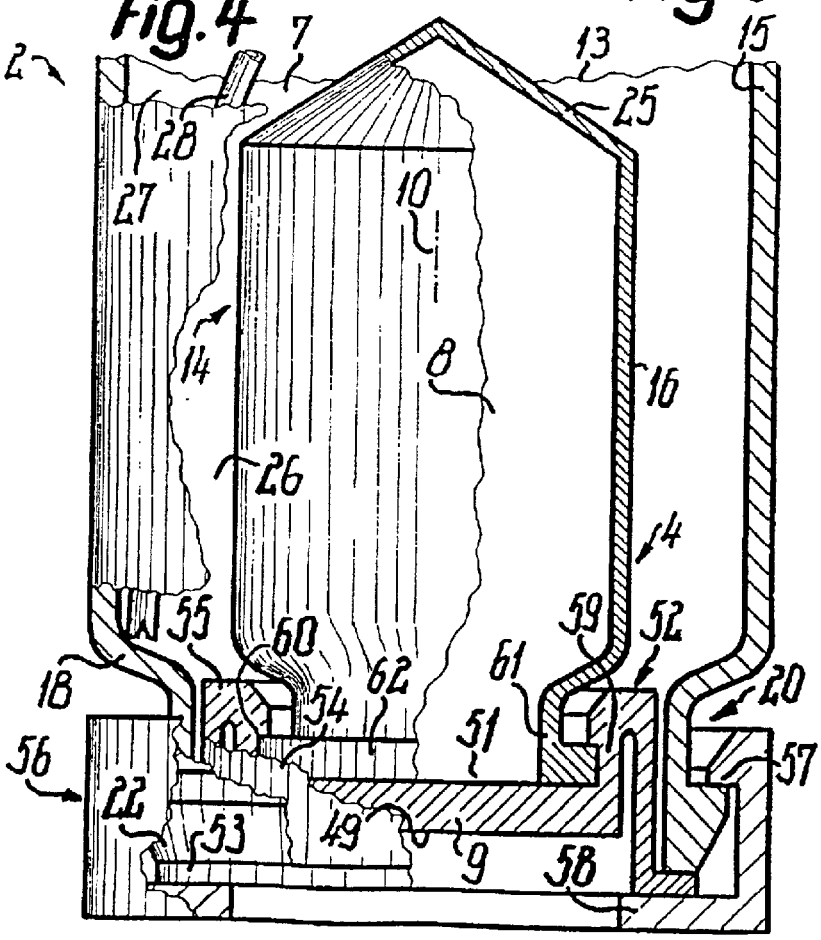

28
25
13
7
14
8
16
15
26
2
9
51
18
61
62
56
52
53
22
54
55
58
4
10
49

63
48
20

MEDIA DISPENSER

CROSS REFERENCE TO RELATED APPLICATION

This is a continuation-in-part of U.S. application Ser. No. 09/615,391, filed Jul. 13, 2000, and now abandoned.

TECHNICAL FIELD AND BACKGROUND OF THE INVENTION

The invention relates to a dispenser for discharging a single medium or two or more media in a sequence of doses or discharging two or more media at the same time in an individual dose. Each of the media may be a liquid, a paste, a powder, a solid tablet or, may be in a gaseous form. The media may be discharged via separate outlet ducts and respective outlets or via a common outlet duct and may be intermingled either in the outlet flow or prior to entering the outlet flow. In all dispensing actions, the dispenser permits ease of handling as well as actuation with a single hand. The dispenser is comprised of plastic, particularly injection molded parts, and may also contain glass parts.

OBJECTS OF THE INVENTION

A general object of the invention is to provide a dispenser which overcomes the drawbacks of known configurations and which permits discharge particularly of two media of the same, or of differing aggregate conditions, which are held entirely separate from each other and then discharged in a plurality of individual doses. Another object is that each medium is decantable or drawn into a metering chamber prior to discharge, before then being discharged directly from this metering chamber. A further object is to permit thorough mingling or easy amalgamating of the media. Still another object is to provide a compact configuration of the dispenser which is easy to handle and simple to manufacture and assemble. A further object is to protect the media from contamination by germs prior to discharge.

SUMMARY OF THE INVENTION

According to the invention the dispenser comprises a base body including a reservoir unit to be provided with a discharge unit for repeated output of the medium dosages from the reservoir unit. The discharge unit could be simply a pour out port for emptying the reservoir unit or it could be some other delivery unit to be preassembled and fitted to the base body, but the discharge unit is preferably a pump.

If the media are to be simply discharged completely from the reservoir unit in one operation, a pump having a single stroke direction is sufficient. Where a multiple-dose discharge is required, the pump executes either an incremental stroke progressing in one direction or an alternating advance and return stroke by which the metering or pump chamber is first emptied and then refilled with the medium from the reservoir unit. The pump may also be formed by a resilient squeeze bottle bounding the reservoir space(s) or mixing chambers for the two media.

The mixing chamber may be separate from both reservoir spaces, may be common with one of the reservoir spaces or may be in common with both reservoir spaces, a good rinsing of these spaces then being provided by mixing.

One reservoir space is a preassembled, filled or sealingly closed module secured to the other reservoir so that the reservoir spaces are separated from each other only by an integral closure member. On opening this closure member, which is flexible on bending or pressure stress, each medium is able to flow from its reservoir space into all other reservoir spaces. The closure member or some other member may then form a swirler guide in the mixing chamber. For instance, this swirler guide may be entirely freely movable in the mixing chamber by mass forces after it has been released or snapped off from its mount on the base body.

Prior to mixing the media, the mixing chamber or the reservoir spaces may be volumetrically smaller than at the start of merging and thereafter. For example, a concave wall of a reservoir space may be turned inside out into a convex shape and then protrude or submerge into another reservoir space, as a result of which the pressure in this other reservoir space is increased which also enhances initial activation or priming of the discharge unit.

The invention provides a receptacle body having two separate reservoir openings to be closed by separate members and/or located opposite each other coaxially. Each opening is formed by a neck constricted as compared to the main portion of the reservoir body. This neck has an integral and protruding mounting fixture for a counter-member, such as a snap ring, a metallic crimp ring, a threaded member or the like. The counter-member serves to sealingly fasten or tension a closure unit which may include the discharge unit or the module including the second reservoir space. The reservoir body is integral and its necks may be identical so that both closure members are to be sealingly secured optionally to each of these necks.

BRIEF DESCRIPTION OF THE DRAWINGS

Example embodiments of the invention are explained in more detail in the following and illustrated in the drawings in which:

FIG. 3 is an elevational view in section of a second embodiment of a lower reservoir actuator assembly of the dispenser of FIG. 1;

FIG. 4 is an elevational view in section of a third embodiment of a lower reservoir actuator assembly of dispenser of FIG. 1;

DETAILED DESCRIPTION OF THE PREFERRED AND ALTERNATIVE EMBODIMENTS

Figure 1:
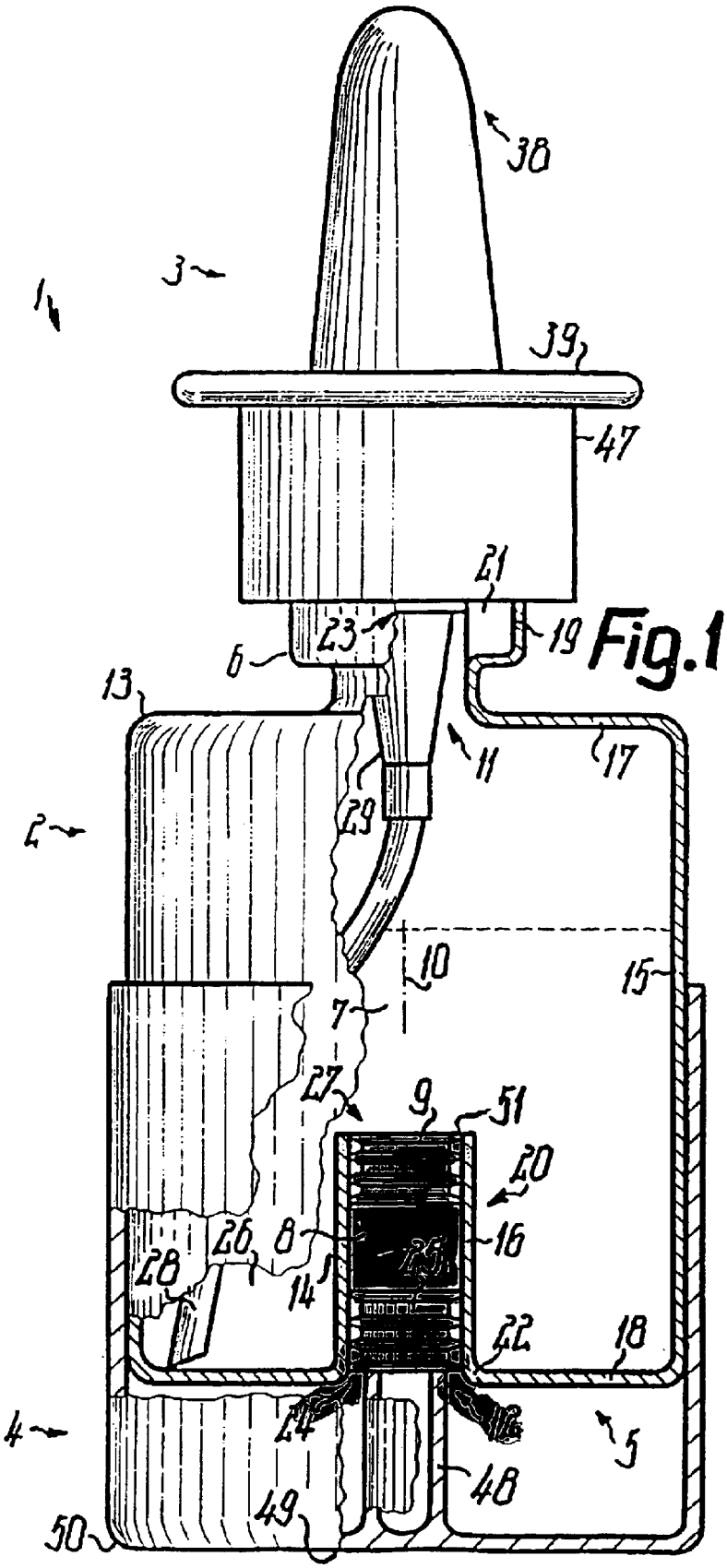
FIG. 1 is an elevational view with parts in section of a dispenser according a first embodiment of the present invention.

The dispenser 1 shown in FIGS. 1 to 8 has three dimensionally rigid dispensing units 2 to 4, each pair of which is movable relative to each other either axially and/or rotatably and independent of the third unit 2 to 4. Dispensing units 3, 4 are axially separate from each other and are movably mounted at opposite ends of middle dispensing unit 2. Dispensing unit 2 has a reservoir body 5 and a base body 6 which are dimensionally rigid. Reservoir body 5 and base body 6 enclose a first reservoir space 7 in which a smaller, second reservoir space 8 is situated. Both spaces 7, 8 border opposite faces of a closure member 9. Closure 9 may be integral with, or a separate piece with respect to, reservoir body 5. All of the above-described assemblies are located along a common longitudinal center axis 10 to which the motions of units 2 to 4 are parallel.

A first discharge or delivery pump 11 is secured to base body 6 and spaced therefrom, a second discharge or delivery unit 12 is fixed to body 6. Pumps 11, 12 can optionally be fixed in common or independently of each other other parts of the dispenser. In FIG. 1 both units are thrust piston pumps 11, 12 having separate piston units. Base body 6 has two integral reservoir bodies or reservoir bodies 13, 14, and a separate housing 29 for pump 11. In FIG. 1, reservoir body 14 provides the pump housing for pump 12.

Reservoir body 13 includes a reservoir jacket 15 of constant width which is coaxial with a smaller reservoir jacket 16 of pump housing 14. Reservoir jacket 15 is made in one part with one of the pump housings for pumps 11, 12. Each end of jacket 15 adjoins an annular, planar end walls 17, 18 forming a top, cover wall 17 and a bottom wall 18 of first reservoir 13. Wall 17 adjoins a receptacle neck 19 having a portion of narrow diameter and then a wider portion extending outward from the narrower portion.

Bottom wall 18 adjoins a neck 20 protruding from wall 18 into space 7. Neck 20 may also protrude partly or totally outwards. Both necks 19, 20 are narrower than jacket 15. Each neck bounds a receptacle or body opening. Neck 19 forms a mounting fixture 21 for rigidly fixing the housing 29. A corresponding mounting fixture or a fastener member 22 is also provided for housing 14 of pump 12. Member 22 is an integral, angularly annular transition between jacket 16 and bottom 18. Parts 13 to 22 are commonly made in one integral part.

Pump 11 and its housing 29 are included in a closure unit 24 sealingly closing neck 19 against penetration of media. Closure 9 and a reservoir bottom and further closure 25 are included in a closure unit 24 sealing off neck 20 from loss of medium to without or from media exchange between spaces 7, 8. Closure 25 is axially spaced from closure 9 and bounds space 8 commonly with closure 9 and jacket 16. Closure 25 extends into the plane of wall 18 and is of same configuration as closure 9 to thus being interchangeable therewith. Piston 25 forms the conveying member of pump 12, namely for both the medium in space 8 and piston 9. In the initial or rest position as shown in FIG. 1 piston 9 or 25 extends up to the associated end of jacket 16. From this end piston 9 or 25 extends into jacket 16.

Jackets 15, 16 bound an annular space 26 adjoining bottom 18 and extending over a partial height of space 7. By advance of piston 9 from jacket 16 into space 7 an outlet or transfer opening 51 is opened at the inner end of neck 20. Via this third body opening 51 the spaces 7, 8 are then connected into a common space, namely a merging or mixing chamber 27. Piston 9 is then freely movable in space 7 and forms a mixing or agitating member for intermingling the two media. The volume of chamber 27 equals that of space 7 and is smaller than the sum of spaces 7, 8.

After intermingling of the media by shaking the dispenser 1, the mixed medium is discharged by pump 11 through housing 29 and unit 3 in single doses each in a time sequence. Housing 29 protrudes by the majority of its length into space 7 and adjoins by its inner end a riser 28 such as an elastomeric riser tube which extends up to bottom 18 of space 26 so that it is only from this location that the medium is drawn out of unit 5.

Regarding the configuration of pump 11 and its fastening or connection to the first reservoir body 13 reference is made to the U.S. Pat. No. 5,927,559, U.S. Pat. No. 5,988,449, U.S. Pat. No. 6,062,433, U.S. Pat. No. 6,059,151, U.S. Pat. No. 6,250,509 and U.S. pat. application Ser. No. 09/387,124, now allowed, as to how these features and effects are incorporated in the present invention.

Figure 2:
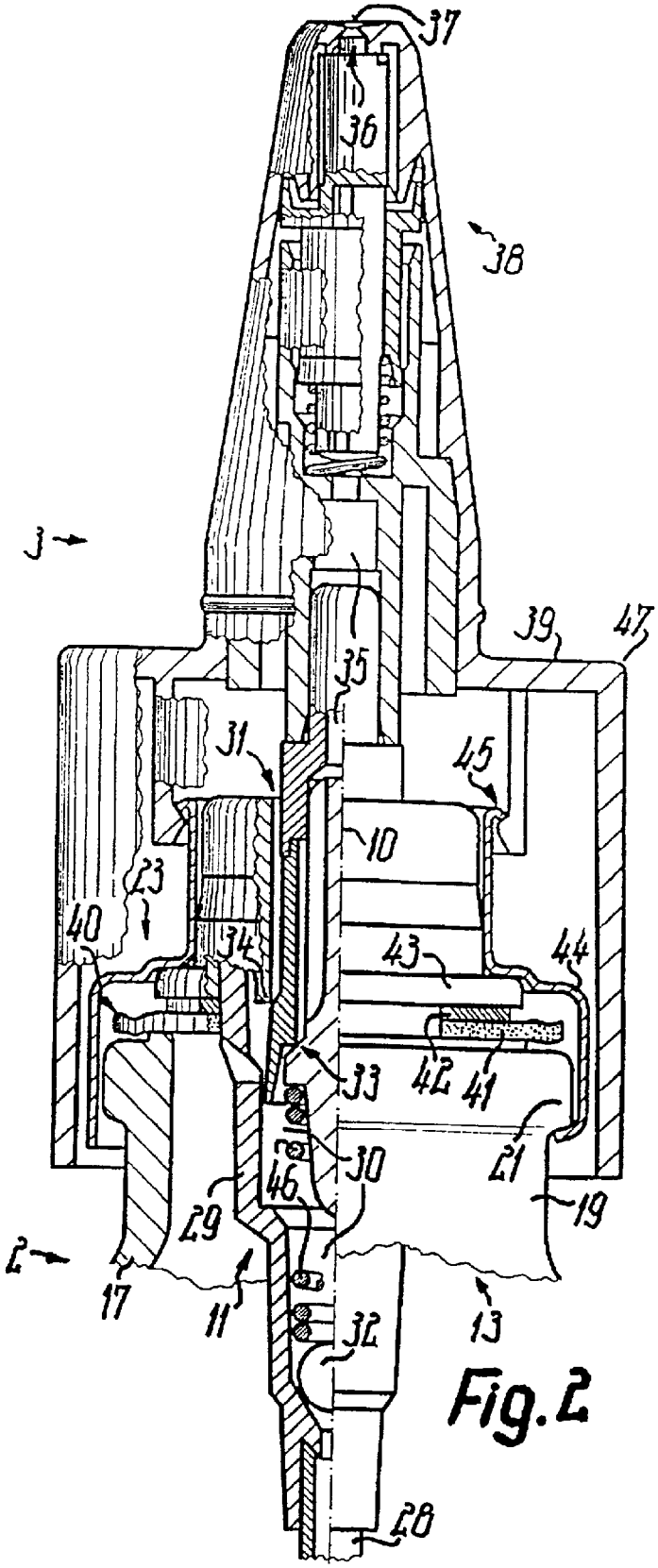
FIG. 2 is an elevational view with parts in section of a second embodiment of an upper pump discharge unit of the dispenser of FIG. 1.

Housing 29 bounds a pressure, metering and pump chamber 30 also bounded between the piston or piston lip of a piston unit 31 and an inlet valve 32 by the inner circumference of housing 29 (FIG. 2). Unit 31 is part of unit 3 and has an outlet valve 33. One valve body is formed by the inner circumference of the resiliently shortenable piston whilst the other valve body is rigidly connected to the plunger stem. In the rest position as shown in FIG. 2 a vent path between housing 29 and plunger stem is sealingly shut by a valve 34. One valve body thereof is formed by the outer circumference of the piston and the other valve body by an inner sleeve of a cover which together with a longer element bounding chamber 30 forms housing 29.

An outlet duct 35 connects downstream to valve 33 and is located entirely within the plunger stem. Duct 35 is provided with means for preventing ingress of germs. These means are directly adjacent to a medium outlet 37, namely an atomizing nozzle, and include a valve 36. Germicidal agents may also be incorporated in the walls bounding duct 35 or any of the other medium spaces. The movable valve body of valve 36 closes in the direction of the discharge flow, whilst the movable valve bodies of valves 32, 33 open in this direction. After opening of valve 33 valve 36 is opened by the medium pressure in duct 35 and is closed by spring force.

Outlet 37 is provided in the end face of a stud 38 for nostril insertion freely protruding beyond a laterally adjoining finger handle 39. Outlet 37 and stud 38 are coaxial with axis 10. For pressure compensation and for withdrawal of the medium from spaces 7, 8 a vent 40 is provided which solely passes a germ filter 41 to thus provide further means for preventing ingress of germs as described. The end cover of pump 11 comprises a protruding, annular flange 43. Filter 41 is axially tensioned and thereby variably compressed commonly with an interposed seal 42 between flange 43 and the end face of neck 19 or mounting fixture 21. Filter 41 is annularly disk-shaped. Rings 41, 42 thus sealingly connect to the outer circumference of housing 29.

Axial tensioning is done with a separate fastener 44, such as a crimp ring illustrated in FIG. 2 before and after tensioning on the left and right respectively. Member 44 supports with tensioning pressure on remote shoulder faces of members 21, 43 and is made of sheet metal. Venting can also flow through housing 29 and valve 34. The jacket of housing 29 is then penetrated by a venting port downstream of chamber 30, this port directly interconnecting the interior of the housing jacket and space 7.

A securing mechanism or a lock 45 positively prevent parts 38, 39 from being withdrawn from the plunger stem or unit 2 although they are secured to the plunger stem only fictionally by a plug-in connection. A return spring 46 located within space 30 moves unit 3 over the return stroke until lock 45 abuts. Handle 39 is formed by the end wall of a cap 47 made in one part with stud 38. The jacket of cap 47 covers the freely protruding cover of housing 29 as well as parts 21, 23 and 41 to 45 permanently as a discharge and actuating head.

A ram shaft 48 is likewise provided for piston 25. Ram 48 is to be actuated manually by an actuator handle 49 facing away from handle 39 when the fingers of one hand simultaneously support spread out on handles 39, 49. Handle 49 is formed by the end wall of a cap 50, the jacket of which slides in snug contact on the outer circumference of jacket 15. The tubular ram 48 freely protrudes integrally from the bottom of cap 50. The free end of ram 48 contacts the outer end face of piston 25. End wall 17 located between handles 39, 49 could also form a counterhold for actuating handle 49 to avoid actuation of pump 11 while space 8 is opened.

It may, however, also be an advantage when pump 11 is first actuated by handle 39 due to a sequence control up to the end position of its pump stroke, before pump 12 is actuated by handle 49 in this position so that on release of handles 39, 49 a suction stroke is instantly implemented and the medium is drawn out of chamber 27 into chamber 30. This sequence control may be achieved by the force needed to actuate pump 12 being greater than that for actuating pump 11. If pump 11 is to remain unactuated during hauling by pump 12, the actuating forces are selected correspondingly inverse.

In each of chambers 7, 8 one of the cited media may be stored. Space 8 is totally filled and space 7 is only partly filled up to the level below housing 29 as evident from FIG. 1. By simultaneous finger pressure against handles 39, 49 ram 48, piston 25 and the fill of space 8 firstly push closure 9 out of neck 20 until at the end thereof opening 51 is opened over the inner width of jacket 16 and until in further action the second medium of space 8 is ejected into space 7. Piston 25 then closes opening 51 like piston 9 previously and the bottom of the cap 50 abuts on bottom 18.

The media can then be intermingled homogenously with the assistance of stirring member 9 by shaking. Stem 48 does not perform a return stroke so that only handle 39 and not handle 49 remains shiftable relative to unit 2. By linearly shifting handle 39 opposite to the shifting direction of handle 49 in overcoming the force of return spring 46 chamber 30 is constricted and the medium contained therein compressed until valve 33 opens. Valve 33 opens either due to the overpressure in chamber 30 or due to the piston abutting at the end of the pump stroke.

The medium emerges pressurized from chamber 30 through valve 33, flows through the inner circumference of the piston sleeve to valve 36 which it opens, before then emerging through outlet 37 atomized to the environment. On release of handle 39 unit 3 executes the return stroke. Thus on opening of valve 32 medium is sucked from chamber 27 into chamber 30. The next stroke cycle results in discharge of the next dose.

FIG. 3 illustrates units 12, 14 separate from body 13 and secured thereto by an adapter or annular flange body 52 commonly in one part with members 16, 25, 49. In addition neck 20 protrudes counter neck 19 outwards only beyond bottom 18 and comprises at the end or outer circumference a protruding fastener member 22 corresponding to member 21. An annular disk seal 53 is tensioned against the end face of sections 20, 22, integrally adjoins the upstream end of a jacket 54 and envelopes jacket 16 with a radial spacing. Thus sections 53, 54 provide a first closing section and closure 9 provides a second closing section while also providing means for preventing assembling stress for the closure.

Via a connection 55 the other or downstream end of jacket 54 adjoins axially spaced from seal 53 within neck 20 the inner end of jacket 16 and forms in the region of this connection 55 an annular hinge for turning or inverting reservoir body 14 inside out. Jacket 16 then forms an elongation of jacket 54 protruding into space 7. The inner bounds of second reservoir body 14 then form its outer bounds which in turn bound annular space 26. Parts 16 and 53 to 55 are commonly in one part. A sleeve- or cap-shaped, as well as separate, fastener 56 tensions elastomeric body 14, 52 against mounting fixture 22 and supports thereon via an annular, resilient snap connection 57 and on seal 53 with a buttress 58, namely an annular end wall, located with spaces from and between its ends.

Closure 9 is a dimensionally rigid or resiliently bendable plate which by its outer circumference sealingly engages inside an annular groove at the inner circumference of jacket 16. The jacket of fastener 56 protrudes beyond reservoir body 14 and handle 49 formed by reservoir bottom 25. Jacket 54 may be spaced from neck 20 by a gap or may sealingly contact the inner circumference thereof either with no tension or radially tensioned. Connection 57 automatically resiliently returns to its locking state when integral member 56 is shifted onto neck 20.

Body 14, 52 is inherently stable in two positions, namely, in the rest position of FIG. 3 and in the inverted position which can be held by an additional snap fastener locking this end position. By finger pressure against handle or actuator 49 reservoir body 14 is turned inside out, during which closure 9 snaps out of its anchorage so that opening 51 is opened. After being turned inside out chamber 27 is smaller than space 7 and after mixing, a discharge is effected by pump 11.

FIG. 4 illustrates that instead of closure 9 the reservoir body 14 is made separate from flange body 52 and the reversible jacket 59 is made in one part with closure 9. Closures 9, 25 are located inversely to the arrangement of FIG. 1. Closure of bottom 25 is fixedly or integrally connected to jacket 16 and is planar, pointed or conical. At the other end located within sections 20, 52 the jacket 16 translates integrally into a constricted receptacle neck 61 including a fastener or snap member 62 to be fixed to sections 9, 52 by a snap connection 60. As a flat disk closure 9 then sealingly contacts the end face of neck 61 and integrally adjoins jacket 59. Jacket 59 includes at the inner circumference an annular snap groove for engagement of member 62. Jacket 59 may have the effect of jacket 16 of FIG. 3 and adjoins jacket 54 via an annular disk 55.

In this case handle 49 is formed by the outside of closure 9. Pressing handle 49 advances reservoir body 14 into space 7 until the snap connection 60 is released and permits reservoir body 14 to freely drop or submerge into space 7. Sections 9, 59 can then be turned inside out or remain in their second stable position inside space 7 while opening 51 bounded by neck 61 is free. In this case the volume of chamber 27 is smaller than the sum of volumes of spaces 7, 8 but larger than volume of the chamber 7.

The stirring member is formed in this case by reservoir body 14, the space 8 of which forms part of the mixing chamber 27. Wall 58 is located here at the end of fastener 56 and axially adjacent to closure 9 or handle 49. Wall 58 comprises an opening for permitting passage of the users finger to be laid against handle 49.

Figures 5, 6, 7:
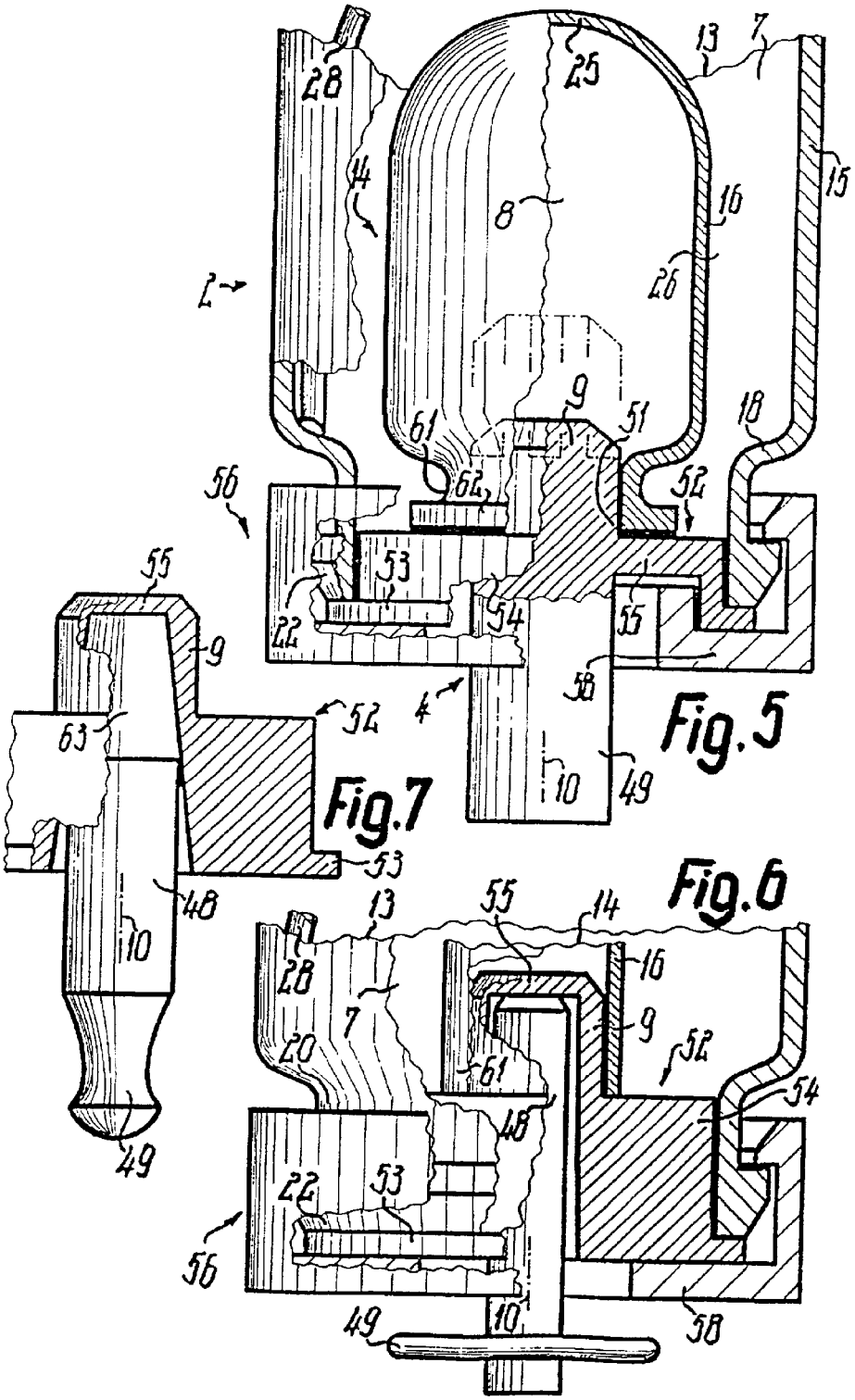
FIG. 5 is an elevational view in section of a fourth embodiment of a lower reservoir actuator assembly of dispenser of FIG. 1.
FIG. 6 is a further embodiment of the lower reservoir actuator assembly of FIG. 5.
FIG. 7 is another embodiment of the actuator seen in FIG. 6.

In FIG. 5 closure 9 includes a stopper extending into neck 61 and sealingly contacting the inner circumference of the neck or of opening 51 by radial pressure. The stopper directly connects to end wall 55. Adjoining the outside of end wall 55 is a likewise integral further projection or mandrel which outwardly traverses the opening in wall 58 to form handle 49 outside of fastener 56. Wall 55 too, may sealingly contact the end face of neck 61 or collar 62. In this case opening requires the handle 49 to be drawn axially outwards whereby wall 55 is able to enter the opening of wall 58 and whereby plug 9 is withdrawn from reservoir body 14. Since reservoir body 14 is exclusively fastened to body 52 via plug 9 it then becomes freely movable and opened in the manner already described.

However, closure 9 may also continue to support or align reservoir body 14 even after communication between spaces 7, 8 has been established, as is indicated in dot-dashed lines in FIG. 5. Therefore, plug 9 is correspondingly elongated and cooperates with the inner circumference of neck 61 as a valve, such as a slide valve. This valve may not only be openable, but also recloseable with handle 49 or by the resiliency of body 52 on release of handle 49.

The movable valve element or closure 9 has valve ducts, e.g. outer circumferential axial grooves which due to the opening motion emerge partially from opening 51 to establish the communication between spaces 7, 8. Reservoir body 14 may then be firmly and frictionally reconnected with plug 9 and moves into space 7 on the return motion of body 52. The contact of collar 62 on wall 55 is thereby suspended. However, reservoir body 14 could also be prevented from executing this motion by a stopper or some other holding means. Bottom 25 is, in cross section, outwardly and convexly round or spherical, and in particularly hemispherical.

Reservoir body 14 of FIG. 6 provides similar effects and is formed by a test glass with jacket 16 of constant width throughout. Like the body 52 closure 9 is also hollow up to end wall 55 forming the inner end of stopper 9 and contacted on its inside by the inner end of stem 48. The outer end protrudes out of fastener 56 and carries handle 49. When stem 48 is shifted inwardly it stretches closure 9 axially and thus provides means constricting the outer width of closure member 9. Thereby the retaining connection with reservoir body 14 is suspended and reservoir body 14 is freely transferred into space 7. In this case, as in FIG. 5, the mixing chamber is the same in size as the sum of spaces 7, 8.

In FIG. 7 the inner end 63 of stem 48 forms an acute angled cone self-lockingly engaging the blind hole of body 52 with radial tension. The hole extends up to wall 55. On pushing in stem 48 the section 63 widens closure 9 with or without adjoining section 54. Thus the radial pressure against the inner circumference of neck 61 or 20 is effected. Retraction of stem 48 suspends this pressure to release reservoir body 14 in FIGS. 5 and 6. According to FIGS. 3 to 7 only the movable parts of body 52 and reservoir body 14 or stem 48 are included in unit 4. Body 52 could also be in one part with body 56.

Figure 8:
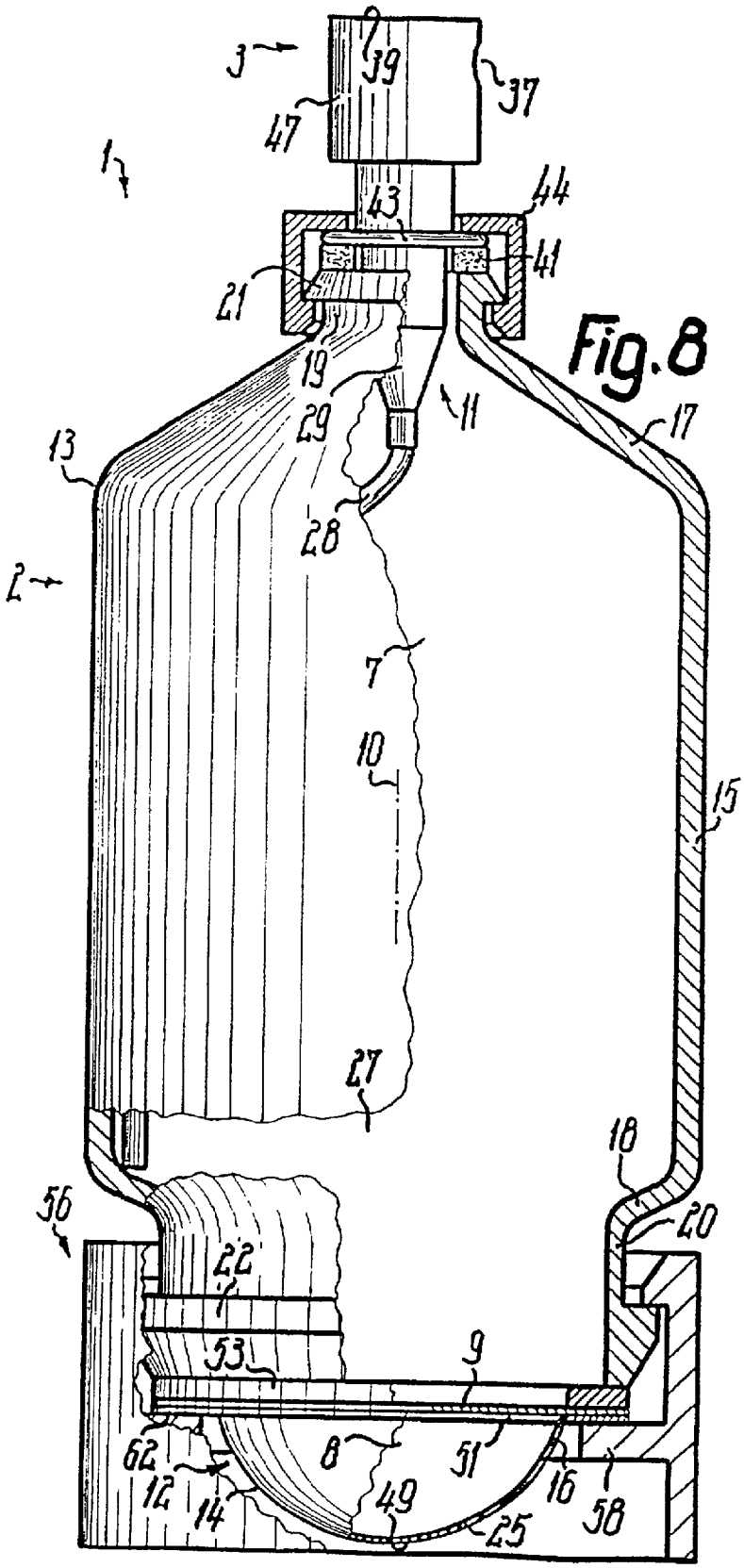
FIG. 8 is a further embodiment showing a third type of upper pump assembly and yet another alternative embodiment of lower reservoir actuator assembly of FIGS. 3, 4 and 5.

The dispensers 1 according to FIGS. 3 and 8 operate similarly except that in FIG. 8 reservoir body 14 is formed by a foil blister containment incorporating creaseable foil walls 16, 25 which form a dish less than hemispherical and translating integrally into a planar flange 62. The dish opening 51 including the annular flange plate 62 is covered by a planar film or foil 9 of metal or plastics which with seal 53 interposed supports against the end face of neck 20, 22 with that tension which is exerted by wall 58 directly on flange 62.

Bottom 25 or an adjoining actuating element forms handle 49 with which reservoir body 14 is pushed toward space 7. Thereby closure 9 is torn open and the powder contained in space 8 enters into the liquid in space 7 while changing over to solution in the liquid. The tear tabs of closure 9 then protruding into space 7 form guide faces which swirl the flow in chamber 27 when the dispenser is shaken. Reservoir body 14 must not be elastomeric or positionally stable in the inverted position or returnable into the position shown in FIG. 8.

Outlet 37 is here oriented transverse or radial to axis 10. The outermost end of discharge head 47 forms handle 39. Fastener 44 is a plastic snap-action ring. Germ filter 41 is not assigned with a separate seal. Thus filter 41 exclusively and semi-permeably seals or permits no passage of liquid but only of air entering radially before then flowing axially between neck 19 and housing 29 into spaces 7, 8, 27.

Devices 11, 12 are independently fastenable to, and non-destructively detachable from unit 2 and reservoir body 13 by fasteners 44, 56. Thereby reservoir body 14 can be fastened as a preassembled unit also including body 52 or seal 53 and housing 56.

It will be appreciated that all features of all embodiments are interchangeable or supplementary to each other so that all passages of the description apply to all embodiments. The size relationships as illustrated are favorable. All cited effects and properties may be provided precisely as described, or merely substantially or approximately so and may also greatly deviate there from depending on the particular requirements.

Instead of a spray jet outlet 37 may output discrete droplets or a non-sprayed jet. Reservoir body 13 or 14 may be made of glass instead of plastics. Reservoir body 14 is also suitable for being primarily filled with a solution of a powder or some other temperature- or moisture-sensitive solid product in a liquid hereafter drying or freeze-drying is done. Thereby closure 9 may already be connected to reservoir body 14 as a unit which then, when filled with the dried substance is assembled with the dispenser or units 2, 6.

The dispenser 1 shown in FIGS. 9 to 11 comprises a discharge unit 11 as shown and described with reference to FIGS. 1, 2 and 8. It is a thrust piston pump having a discharge head 47 which is likewise used as an operating pusher for the pump. The operator can put his finger on surface 39 and operate the pump by pressing the pusher downwardly in the direction of pump axis 10.

Pump 11 has a base body 106 and is mounted by a sleeve-shaped fastener 44 on a mounting fixture portion 21 of neck 19 of reservoir body 13. The pump 11 is connected to a riser tube 28 for sucking medium out of reservoir body 13.

Figure 11:
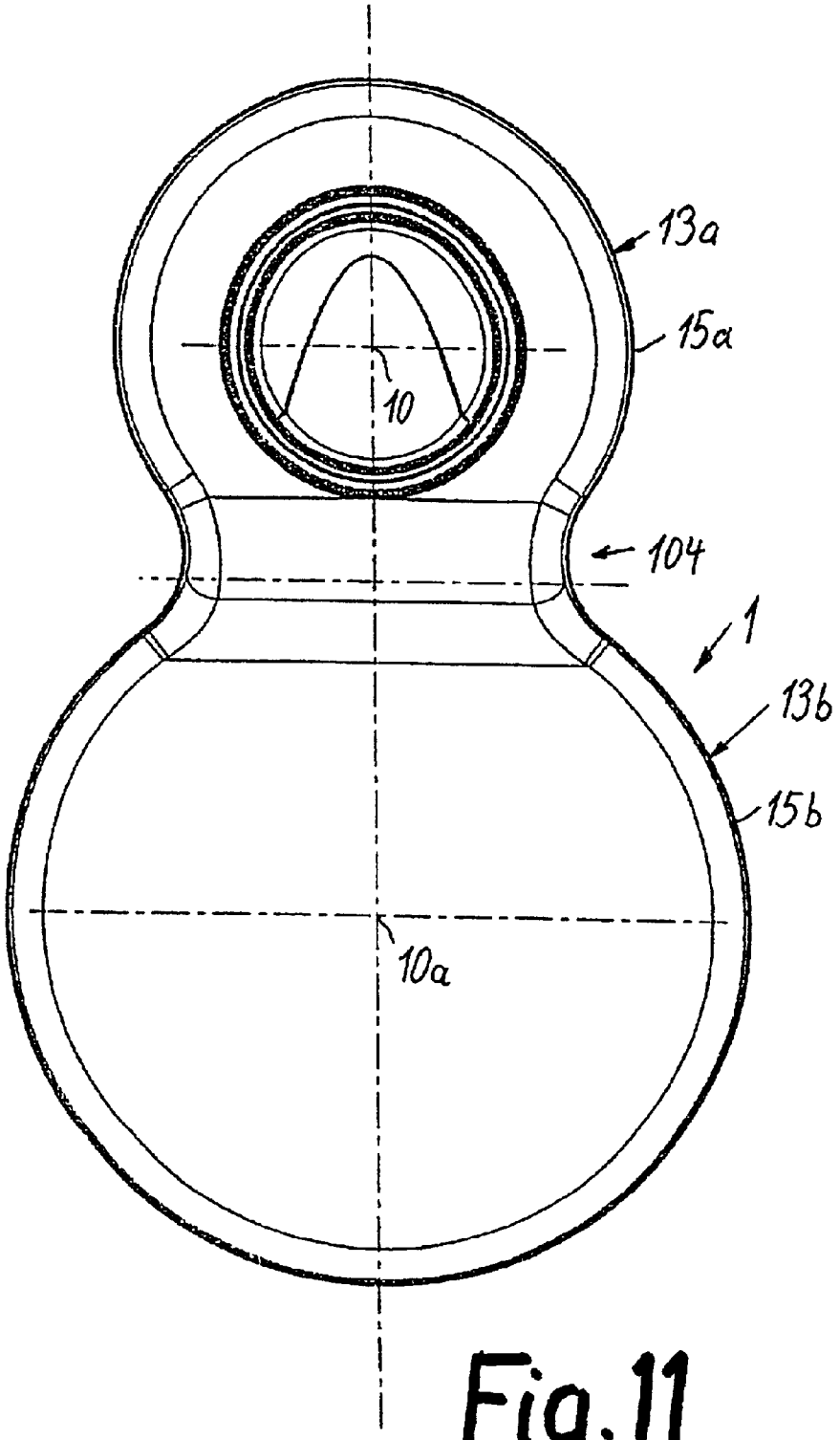
FIG. 11 shows a top plan view on the device of FIGS. 9 and 10.

The reservoir body 13 has, as can be seen from FIG. 11, a figure-8 shaped cross-section consisting of a smaller compartment 13*a* and a larger compartment 13*b*. Both compartments are partly cylindrical with circular jackets 15*a*, 15*b* and a flat bottom 18. Both jackets 15*a*, 15*b* are circular around axis 10 and an axis 10*a*, respectively. They are joint together at a restriction 104 of the cross-section so that the compartments 13*a*, 13*b* communicate with each other.

In the larger compartment there is also a neck 20 protruding outwardly from a top wall 17 of reservoir body 13. It ends in a flange 22 having a conical outer surface 22*a* and a shoulder 22*b* for a snap connection 57 with the lower rim of a fastener ring 56. The ring has a sleeve-like jacket 57*a* and an annular intermediate wall 57*b* and circular rim 57*c* with a circular snap protrusion 57*d* on its inside.

In compartment 13*b* of reservoir body 13 a second reservoir body 14 is positioned. It has the shape of a cylindrical bottle or vial with a rather wide neck 61 having a circular groove 61*a* and a flange 61*b* near its end face 61*c*.

The second reservoir body 14 is sealingly closed and connected to the first reservoir body 13 by a closure unit 52 which is made from a resilient material like rubber and has the shape of a circular bellow. It has an outer triangular flange 9*a* which is healingly enclosed and pressed against conical surface 22*a* and the intermediate wall 57*b* when the fastener ring 57 is fixed to the reservoir body 13 by the snap joint 57. Closure unit 52 has, inside the flange 9*a*, a circular bead with a thick outer wall, while its inner section 9*c* is rather thin and membrane-like. Flange 61*b* is fixed, in the rest position shown in FIG. 9, in an inwardly open groove 119 between a sealing surface 54, the thin, flexible section 9*c* and a shoulder at the bead 9*b*, which grips the flange 61*b* and protrudes somewhat into groove 61*a*. Thereby the sealing surface 54 of the closure member is pressed onto the end face 61*c* of the second reservoir body 14. The sealing surface 54 is the lower face of a horizontal section 9 of the closure unit 52 situated between the thin section 9*c* and a central section 9*d* bulging inwardly, i.e. into opening 51 of the second reservoir body 14.

Figure 9:
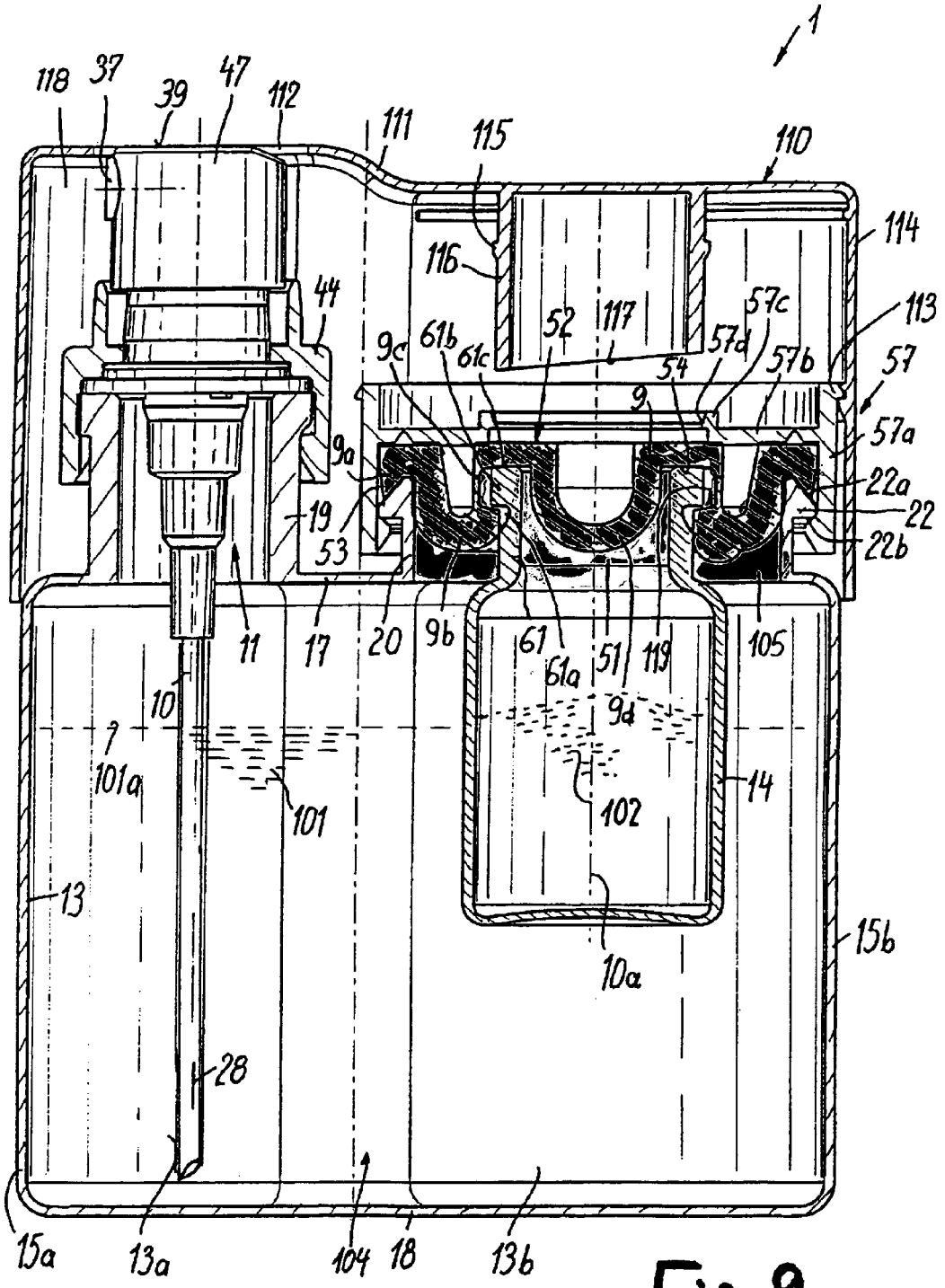
FIG. 9 shows a further preferred embodiment of the invention in elevation with parts in section in its state before operation.

It can be noted from FIG. 9 that the closure unit 52, which is a one-piece ring bellow from rather flexible material constitutes with its outer sealing surface 53, which is defined between flange 9*a* and conical surface 22*a*, a tight seal for the opening 105 of reservoir body 13. In the unused rest position, it constitutes a tight seal for opening 51 of the second reservoir body 14 by contact between end face 61*c* and sealing surface 54.

Dispenser 1 is at its top covered by a protective cap 110 which has, in a horizontal cross-section, nearly the same shape as the first reservoir body 13 described before. Its inversed cup-shape is somewhat larger than that of reservoir body 13 so that it may slide over it. The cap has, as its top wall 111, an opening 112 of a size somewhat larger than that of the operating pusher 47. The top wall 111 is, in the area of the discharge unit 11, somewhat raised and flush with the operating surface 39 of the pusher 47.

There are two snap joints between the protective cap 110 and the main unit including reservoir body 13 and ring fastener 57. A first snap joint 113 is active in the rest position shown in FIG. 9 and is provided by corresponding protrusions and notches on the outer upper portion of ring fastener 57 and at the jacket 114 of the protective cap 110. The second snap joint 115 is active in the position shown in FIG. 10 and comprises corresponding protrusions or rips 57*d* on the inner part of fastener 57 and on the outer circumference of a sleeve protruding downwardly from the top wall 111 of the protective cap. This sleeve constitutes an opening means 116. The cylindrical sleeve 116 is coaxially with the second reservoir body 14, i.e. with the axis 10*a* of compartment 13*b*. Its lower face 117 is somewhat inclined so that it will meet the upper face of closure member 52 first with its part which is nearer to the discharge unit.

FIG. 9 shows also that the first reservoir body 13 is filled with a first, usually liquid medium 101 up to a level 101*a*, while the second reservoir body 14 is filled with the second medium 102 which may be a liquid or a powder.

As can be seen from FIG. 9 the dispenser is in the rest position and prevented from being operated by the protective cap 110. The operating pusher surface 39 is situated in the chamber 118 formed within the cap 110. It can be reached by a finger but not operated because its surrounding is covered by the protective cap. For operating the dispenser, it is first necessary to press the protective cap 110 downwardly, overcoming the snap action 113.

Figure 10:
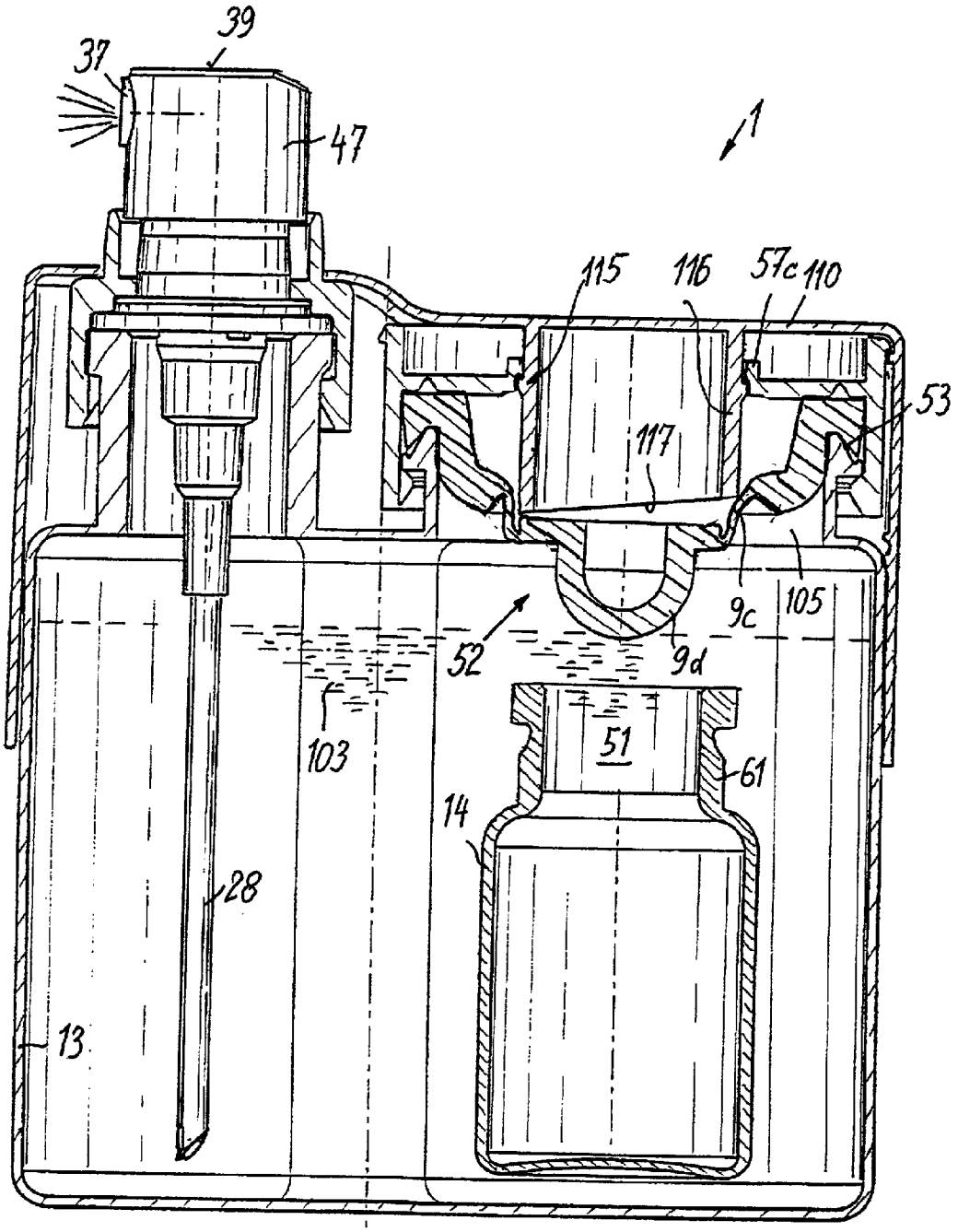
FIG. 10 shows the device of FIG. 9 being prepared for operation.

The closure cap 110 will then be held by action of the snap joint 115 in its position shown in FIG. 10 which is the active or release position of the dispenser. The protective cap does not only protect the dispenser in its rest position, but also prevents use of the dispenser without mixing the media. It provides an automatic mixing operation before the dispenser can be operated. In this release position the protective cap will then expose the operating pusher through the opening 112, while the opening means 116 meets the closure member 52 at its upper face and presses the middle of it downwardly. Inclined lower face 117 meets the middle part of closure member 52, which will be somewhat tilted to ease pealing out rim 61*b* of reservoir body 14 from its sealing grip in the inner notch 119. The closure member 52 is deformed and snaps into a stable position as shown in FIG. 10. The whole middle part including bead 9*d* is moved downwardly and container 14 is opened, thrown downwardly into reservoir body 13 and submerged in medium 101. The closure member 52 keeps the opening 105 of reservoir body 13 closed.

The first medium 101 can now flow into the second reservoir body 14 and the second medium can flow out of it so that both media are merged and mixed to a new mixed medium 103, which can be dispensed from a spray opening 37 in the operating pusher 47 when the operator presses his fingers on the operating surface 39 which is now accessible.

We claim:

1. A dispenser for discharging media comprising:

a base body, a reservoir assembly retained on said base body and including a first reservoir body for storing a first medium and a second reservoir body for storing a second medium, said first reservoir body being provided for containing mixed media, a discharge unit including a pump for discharging the mixed media through a medium outlet, said base body including a mounting fixture for fixing said discharge unit on said first reservoir body, said first reservoir body including a first opening and a second opening apart from said first opening, said discharge unit closing said first opening, said second reservoir body including a third opening through which the second medium is expelled into the first reservoir body to be mixed with the first medium, a closure unit sealingly closing both said second opening and the third opening, said closure unit including a first sealing surface and a second sealing surface spaced from said first sealing surface, said first sealing surface directly contacting said first reservoir body for sealingly closing the second opening and said second sealing surface directly and sealingly contacting said second reservoir body for sealingly closing said third opening, the closure unit being flexible and deformable at least at said second sealing surface, wherein said third opening can be opened while said second opening remains sealingly closed, and wherein said first reservoir body and said second reservoir body include reservoir necks and a reservoir belly wider than said reservoir necks, said reservoir necks including a first neck and a second neck spaced from said first neck, and said closure unit including an annular flange directly contacting said second neck.

2. The dispenser according to claim 1, said second reservoir body further including a reservoir jacket and a reservoir bottom connected to said reservoir jacket, said reservoir jacket defining the third opening which is closed by said closure unit, and means being included for opening said second reservoir body into the first reservoir body with said third opening being opened.

3. The dispenser according to claim 2, wherein said means for opening includes a handle for entirely pushing said second reservoir body into the first medium.

4. The dispenser according to claim 3, wherein said second reservoir body is fixed to said closure unit with a snap fit, said opening being openable by actuating said handle.

5. The dispenser according to claim 1, wherein said a portion of said closure unit engages inside said reservoir jacket.

6. The dispenser according to claim 1, wherein a portion of said closure unit engages inside said opening and means are included for radially constricting said closure unit.

7. The dispenser according to claim 1, wherein said pump includes a thrust piston pump including a pressure chamber and a spring powering a return stroke, said pump including a piston unit including a pump piston and an outlet valve for said pressure chamber.

8. The dispenser according to claim 1, wherein means are included for preventing ingress of germs into at least one of said first reservoir body and said second reservoir body.

9. A dispenser for discharging media comprising:

a base body, a reservoir assembly retained on said base body and including a first reservoir body for storing a first medium and a second reservoir body for storing a second medium, said first reservoir body being provided for containing mixed media, a discharge unit including a pump for discharging the mixed media through a medium outlet, said base body including a mounting fixture for fixing said discharge unit on said first reservoir body, said first reservoir body including a first opening and a second opening apart from said first opening, said discharge unit closing said first opening, said second reservoir body including a third opening through which the second medium is expelled into the first reservoir body to be mixed with the first medium, a closure unit sealingly closing both said second opening and the third opening, said closure unit including a first sealing surface and a second sealing surface spaced from said first sealing surface, said first sealing surface directly contacting said first reservoir body for sealingly closing the second opening and said second sealing surface directly and sealingly contacting said second reservoir body for sealingly closing said third opening, the closure unit being flexible and deformable at least at said second sealing surface, wherein said third opening can be opened while said second opening remains sealingly closed, and wherein the discharge unit has an operating pusher which is, in a rest position, inhibited from being operated by a protective cap, which is provided to be moved, before operating the discharge unit to a release position, in which the operating pusher is enabled to be operated, said cap having locking means to be locked in the release position, and having opening means for opening the second reservoir body and enabling merging of the media.

10. The dispenser according to claim 9, said second reservoir body being fixed to said closure unit with a snap fit.

11. The dispenser according to claim 9, wherein the cap, in the rest position, at least partly covers the operating pusher.

12. The dispenser according to claim 9, wherein the cap is held in the release position by a snap joint.

13. The dispenser according to claim 9, wherein the opening means comprise an opening pusher formed inside the cap and acting on the closure unit.

14. The dispenser according to claim 9, wherein the closure unit is a flexible circular bellow having an outer ring section cooperating with the first reservoir body to seal the second opening and an inner ring section cooperating with the second reservoir body to seal the third opening, the opening pusher being provided to act on the inner ring section to deform the closure unit to open the third opening and to displace the second reservoir body within the first reservoir body.

15. The dispenser according to claim 14, wherein the closure unit has at least one thin substantially sleeve-like section, between the outer and inner ring section.

16. The dispenser according to claim 9, wherein the discharge unit is situated beside and spaced from the second reservoir body and its closure unit, the operating pusher, the cap and the opening means being moveable in a same direction.

17. The dispenser according to claim 9, wherein the first reservoir body has, in cross-section, a FIG. 8 shape with a smaller compartment for the discharge unit and a larger compartment for the second reservoir body.

* * * * *